US012680282B2

(12) United States Patent
Huang et al.

(10) Patent No.: US 12,680,282 B2
(45) Date of Patent: Jul. 14, 2026

(54) MULTIFUNCTIONAL FAUCET

(71) Applicant: Clement Inc., Flushing, NY (US)

(72) Inventors: Lengjie Huang, Quanzhou (CN); Chunhua Wang, Xiamen (CN); Yongqiang Yan, Fuzhou (CN)

(73) Assignee: CLEMENT INC., Flushing, NY (US)

( * ) Notice: Subject to any disclaimer, the term of this patent is extended or adjusted under 35 U.S.C. 154(b) by 95 days.

(21) Appl. No.: 18/418,381

(22) Filed: Jan. 22, 2024

(65) Prior Publication Data

US 2025/0237043 A1 Jul. 24, 2025

(51) Int. Cl.
*E03C 1/04* (2006.01)

(52) U.S. Cl.
CPC ..... *E03C 1/0404* (2013.01); *E03C 1/0403* (2013.01); *E03C 2001/0415* (2013.01)

(58) Field of Classification Search
CPC ..... E03C 1/0404; E03C 1/0403; E03C 2001/0415
See application file for complete search history.

(56) References Cited

U.S. PATENT DOCUMENTS 5,361,431 A * 11/1994 Freier ..... E03C 1/108 4/677
6,915,817 B2 * 7/2005 Benstead ..... E03C 1/04 137/355.25
7,748,406 B2 * 7/2010 Pilatowicz ..... E03C 1/08 239/443
8,689,818 B2 * 4/2014 Marty ..... E03C 1/0404 4/678
10,711,936 B2 * 7/2020 Lin ..... F16L 55/00
2010/0043898 A1 * 2/2010 Eckhaus ..... F16K 19/006 137/625

* cited by examiner

*Primary Examiner* — Janie M Loeppke

(57) ABSTRACT

The present disclosure provides a multifunctional faucet with a pull-out function including a water outlet unit and at least two sets of main control units. The water outlet unit includes a first main body, a support tube disposed on the first main body, a water outlet tube being moveable through the first main body and the support tube, and a counterweight block sleeved on the water outlet tube. A water outlet end of the water outlet tube is fitted to an end face of the support tube, and the counterweight block is away from one end of the support tube. The water outlet end of the water outlet tube is pulled out, and the water outlet end of the water outlet tube is away from the end face of the support tube. The water outlet tube is released, and the counterweight block drives the water outlet tube to reset.

9 Claims, 20 Drawing Sheets

MULTIFUNCTIONAL FAUCET

TECHNICAL FIELD

The present disclosure relates to the field of bathroom, and in particular to a multifunctional faucet with a pull-out function.

BACKGROUND

A water outlet of a faucet of a traditional American four-inch or eight-inch basin may only rotate around a longitudinal axis. There is dirt in a dead corner of the basin, for example, bacteria may grow because the dirt is in the basin of a bathroom cabinet. In this case, it is difficult to clean the dead corner. That is, the faucet of the traditional American basin may no longer meet daily usage needs.

SUMMARY OF THE DISCLOSURE

The present disclosure provides a multifunctional faucet with a pull-out function, which may effectively solve the above problems.

The present disclosure is implemented as follows.

A multifunctional faucet with a pull-out function includes a water outlet unit and at least two sets of main control units. The water outlet unit and the main control unit are spaced apart from each other.

The water outlet unit includes a first main body, a support tube disposed on the first main body, a water outlet tube being moveable through the first main body and the support tube, and a counterweight block sleeved on the water outlet tube. A water outlet end of the water outlet tube is fitted to an end face of the support tube, and the counterweight block is disposed away from one end of the support tube. The water outlet end of the water outlet tube is pulled out, and the water outlet end of the water outlet tube is away from the end face of the support tube. The water outlet tube is released, and the counterweight block drives the water outlet tube to reset.

In some embodiments, the first main body defines a first channel and a second channel, and the first channel and the second channel are disposed side by side; the first channel is communicated with the support tube, and the water outlet tube sequentially passes through the support tube and the first channel; and a quick connecting assembly is connected between the second channel and the water outlet tube.

In some embodiments, the quick connecting assembly comprises an adapter and two clamping ring elements, and each of two opposite ends of the adapter is provided with one clamping ring element; each of a peripheral circle of the second channel and one end of the water outlet tube away from the support tube is provided with a positioning rib and a sealing element, and two positioning ribs are respectively inserted into the two clamping ring elements.

In some embodiments, a check valve or a water saving plate is disposed in the adapter.

In some embodiments, the main control unit includes a second main body, and the first main body and the second main body are connected to form a whole or disposed separately.

In some embodiments, the first main body and the second main body are inserted into each other to form a whole, or the first main body and the second main body are injection molded into a whole, and the first main body is communicated with the second main body.

The first main body defines a first channel and a second channel, and the first channel and the second channel are disposed side by side; the first channel is communicated with the support tube, and the water outlet tube sequentially passes through the support tube and the first channel; and a quick connecting assembly is connected between the second channel and the water outlet tube.

In some embodiments, the quick connecting assembly includes an adapter and two clamping ring elements, and each of two opposite ends of the adapter is provided with one clamping ring element; each of a peripheral circle of the second channel and one end of the water outlet tube away from the support tube is provided with a positioning rib and a sealing element, and two positioning ribs are respectively inserted into the two clamping ring elements.

In some embodiments, the first main body further includes two buckle parts spaced apart from each other, and each of two opposite sides of an outer wall of the first main body is provided with the buckle parts; and a buckle position is disposed on a part of the second main body facing towards the first main body, and the buckle part and the buckle position are inserted into each other, so that the first main body is communicated with the second main body.

In some embodiments, a sealing water outlet is disposed on one end of the second main body away from the first main body, the first main body and two second main bodies are injection molded into a whole, and a sealing water plate is disposed on the sealing water outlet and secondary injection molding is performed.

In some embodiments, a lower part of the second main body defines a third channel, an outer wall circumference of the third channel is provided with a connection part, and the connection part is configured to fix the second main body to an external element through a locking nut.

In some embodiments, the first main body and two second main bodies are spaced apart from each other, the first main body is located between the two second main bodies, the first main body is not communicated with the second main body, and a hose assembly is connected between the first main body and the water outlet tube.

In some embodiments, the first main body defines a first channel, and the second main body defines a fifth channel and a third channel; the fifth channel and the third channel are disposed side by side, and each of the fifth channel and the third channel is connected to a connection tube; and the water outlet tube passes through the first channel and connected to the fifth channel through the hose assembly.

In some embodiments, a connection part is disposed on an outer wall of each of the first main body and the second main body, and the connection parts are configured to fix the first main body and the second main body to the external element through a quick connecting nut assembly.

In some embodiments, the counterweight block includes a body and an upper cover disposed on the body, one side of the upper cover close to the body is provided with a clamping buckle element, and the water outlet tube sequentially passes through the clamping buckle element and the body, and the upper cover and the body are gradually tightened, and the clamping buckle element is tightly held the water outlet tube.

The beneficial effects of the present disclosure are as follows. A fixed water outlet of a faucet of the traditional American style basin into a combination of the support tube and the water outlet tube. The water outlet tube passes through the support tube and may be pulled out and automatically reset, which may meet the user's needs to pull out the water outlet end of the water outlet tube anytime and anywhere according to the usage situation. After use, the water outlet tube may be automatically reset by pulling the water outlet tube with a counterweight block, and any position of the basin may be cleaned. Moreover, an insertion structure between the first main body and second main body may achieve rapid assembly, or the first main body and the second main body may be directly injection molded into a whole, thereby improving production efficiency. A quick connecting structure of the quick connecting assembly, the counterweight block, and the quick connecting nut assembly may facilitate faster installation and improve user experience.

BRIEF DESCRIPTION OF THE DRAWINGS

In order to more clearly illustrate the technical solutions in some embodiments of the present disclosure, hereinafter, a brief introduction will be given to the accompanying drawings that are used in the description of some embodiments. Obviously, the accompanying drawings in the description below are merely some embodiments of the present disclosure, which should not be regarded as a limitation of the scope of the present disclosure. For those of ordinary skill in the art, other accompanying drawings may be obtained based on these accompanying drawings without any creative efforts.

EXPLANATION OF REFERENCE SIGNS IN FIG. 1 TO FIG. 29

Figure 1:
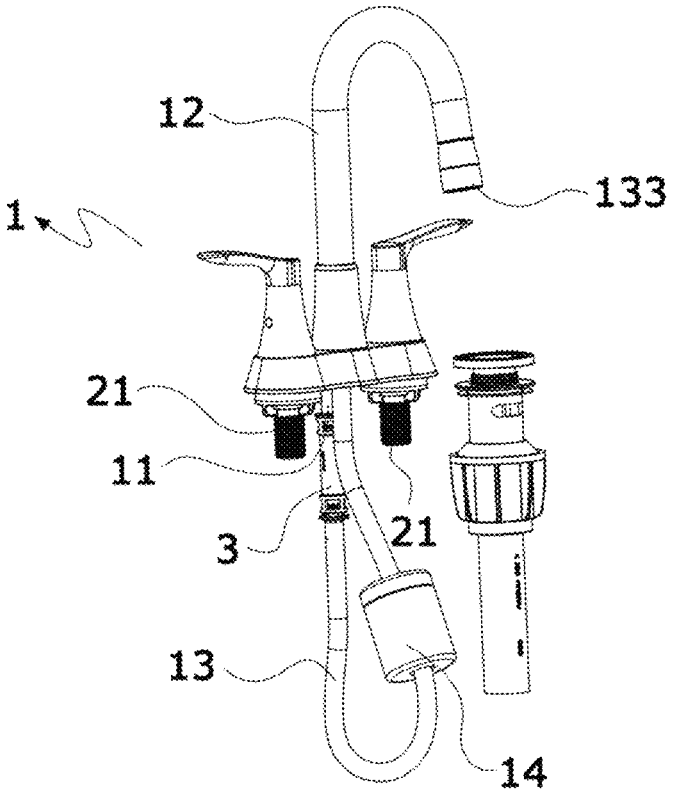
FIG. 1 is an axonometric view of a multifunctional faucet in a first embodiment of the present disclosure.
Figure 2:
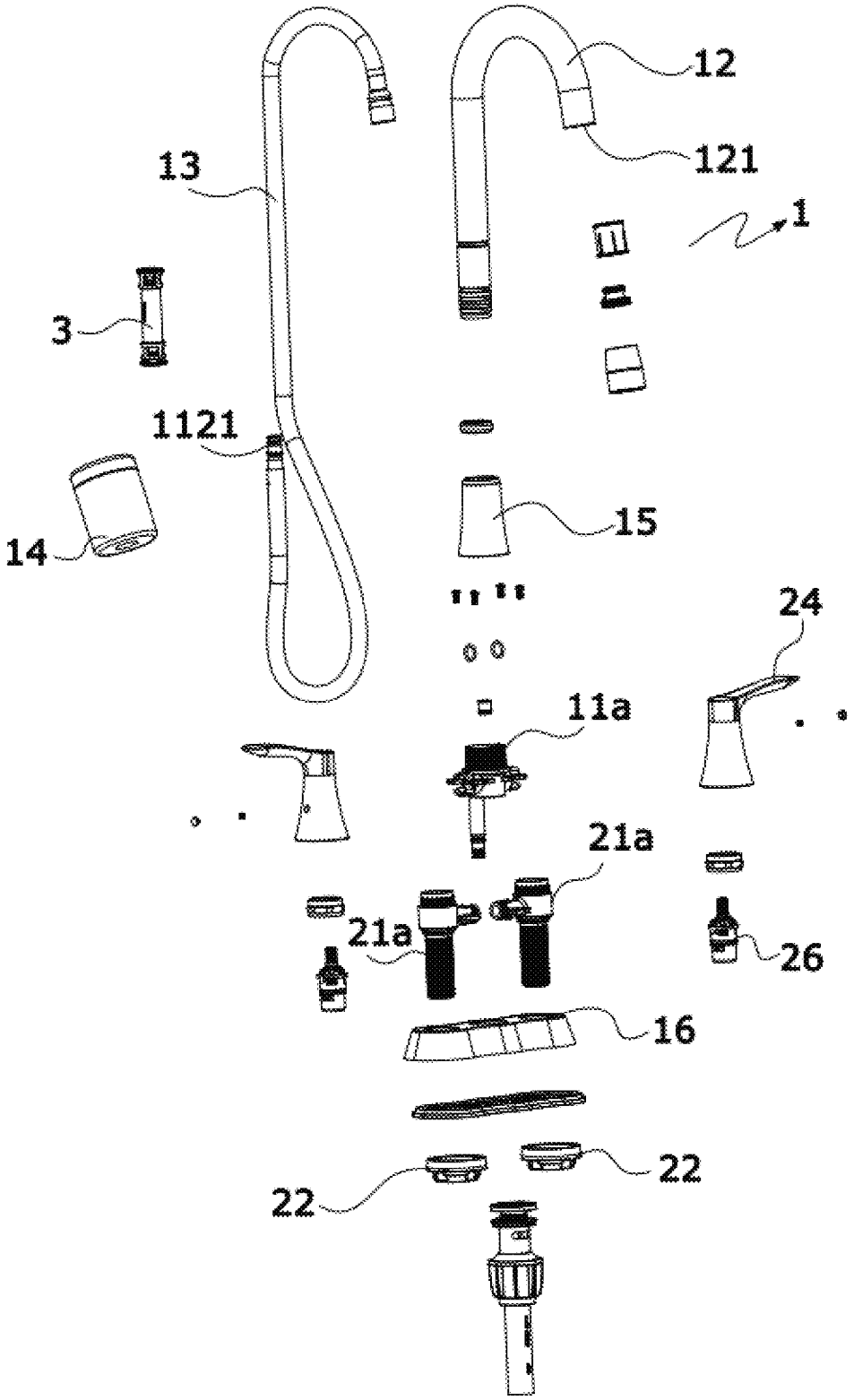
FIG. 2 is an exploded view of the multifunctional faucet in the first embodiment of the present disclosure.

1—water outlet unit; 11, 11*a*, 11*b*, 11*c*—first main body; 111—first channel; 112—second channel; 1121—peripheral circle; 1122—positioning bar; 1123—sealing element; 113—buckle part; 1131—clamping buckle slot; 114—connection part;

12—support tube; 121—end face;

13—water outlet tube; 131—positioning bar; 132—sealing element; 133—water outlet end; 14—counterweight block; 141—body; 142—upper cover; 143—clamping buckle element; 15—flange; 16—panel;

2—main control unit; 21, 21*a*, 21*b*, 21*c*—second main body; 211—sealing water plate; 212—sealing water outlet; 2121—mold core; 213—buckle position; 2131—clamping buckle block; 214—third channel; 215—connection part; 216—fifth channel; 217—connection tube; 218—fourth channel; 219—valve core chamber; 22—locking nut; 23—quick connecting nut assembly; 231—upper body; 232—lower body; 2321—bar; 2322—removable teeth; 24—handle; 25—flange; 26—valve core;

3—quick connecting assembly; 31—adaptor; 32—clamping ring element; 33—check valve;

4—hose assembly.

DETAILED DESCRIPTION

In order to make the purpose, technical solutions, and advantages of the embodiments of the present disclosure clearer, the technical solutions in the embodiments of the present disclosure may be clearly and completely described in combination with the accompanying drawings. Obviously, the described embodiments are a part of the embodiments of the present disclosure, not all of the embodiments. Based on the embodiments in the present disclosure, all other embodiments obtained by those of ordinary skill in the art without creative effort are within the scope of the present disclosure. Therefore, the following detailed description of the embodiments of the present disclosure provided in the drawings is not intended to limit the scope of the claimed protection of the present disclosure, but only represents the selected embodiments of the present disclosure. Based on the embodiments in the present disclosure, all other embodiments obtained by those of ordinary skill in the art without creative efforts fall within the scope of protection of the present disclosure.

The terms "first" and "second" in the present disclosure are only configured to describe purposes and cannot be understood as indicating or implying relative importance or implicit indicating the quantity of technical features indicated. Therefore, features limited to "first" and "second" may explicitly or implicitly include at least one of these features. In the description of the present disclosure, "multiple" or "a plurality of" means two or more, unless otherwise expressly and specifically qualified.

Referring to FIGS. 1 to 29, a multifunctional faucet with a pull-out function includes a water outlet unit 1 and at least two sets of main control units 2. The water outlet unit 1 and the main control unit 2 are spaced apart from each other. On the market, a faucet of a traditional American basin typically has two sizes, four-inch and eight-inch, which is defined according to a distance between the water outlet unit 1 and the two sets of main control units 2. However, a water outlet tube 13 of such a faucet on the market is fixed and cannot be pulled out, making it inconvenient for a user to use.

In order to allow the water outlet tube 13 to be pulled out, the water outlet unit 1 includes a first main body 11, a support tube 12 provided on the first main body 11, a water outlet tube 13 that may be moveable through the first main body 11 and the support tube 12, and a counterweight block 14 sleeved on the water outlet tube 13. A water outlet end 133 of the water outlet tube 13 is fitted to an end face 121 of the support tube 12, and the counterweight block 14 is away from one end of the support tube 12. The water outlet end 133 of the water outlet tube 13 is pulled out, and the water outlet end 133 of the water outlet tube 13 is away from the end face 121 of the support tube 12. The water outlet tube 13 is released, and the counterweight block 14 drives the water outlet tube 13 to reset.

The main control unit 2 includes a second main body 21. The second main body 21 defines a valve core chamber 219, and a third channel 214 and a fourth channel 218 that are communicated with the valve core chamber 219. The valve core chamber 219 is longitudinally disposed, and the fourth channel 218 is horizontally disposed. The valve core chamber 219 is provided with a valve core 26, and a handle 24 is disposed on the valve core 26, and the valve core 26 is controlled by controlling the handle 24, so that the valve core 26 controls the on/off between the third channel 214 and the fourth channel 218. The first main body 11 and the second main body 21 are connected to form a whole or disposed separately. By fixing the first main body 11 and the second main body 21 to an installation table, such as a table of a bathroom cabinet, the faucet is fixed to the installation table.

Example 1

Referring to FIGS. 1 to 8, the first main body 11*a* and the second main body 21*a* are inserted into each other to form a whole. The first main body 11*a* includes two buckle parts 113 spaced apart from each other. One of the two buckle parts 113 is located on a left side of an outer wall of the first main body 11*a*, and the other of the two buckle parts 113 is located on a right side of the outer wall of the first main body 11*a*. A clamping buckle slot 1131 is defined on each of an upper surface and a lower surface of each buckle part 113. A buckle position 213 is disposed on a part of the second main body 21*a* facing towards the first main body 11*a*, and a clamping buckle block 2131 corresponding to a buckle groove 1131 is disposed on each buckle position 213. The buckle part 113 and the buckle position 213 are inserted into each other, and the clamping buckle block 2131 is accommodated in the buckle groove 1131 and buckled, thereby connecting the first main body 11*a* and the second main body 21*a*. The second main body 21*a* is communicated with the first main body 11*a* through the fourth channel 218.

Figure 3:
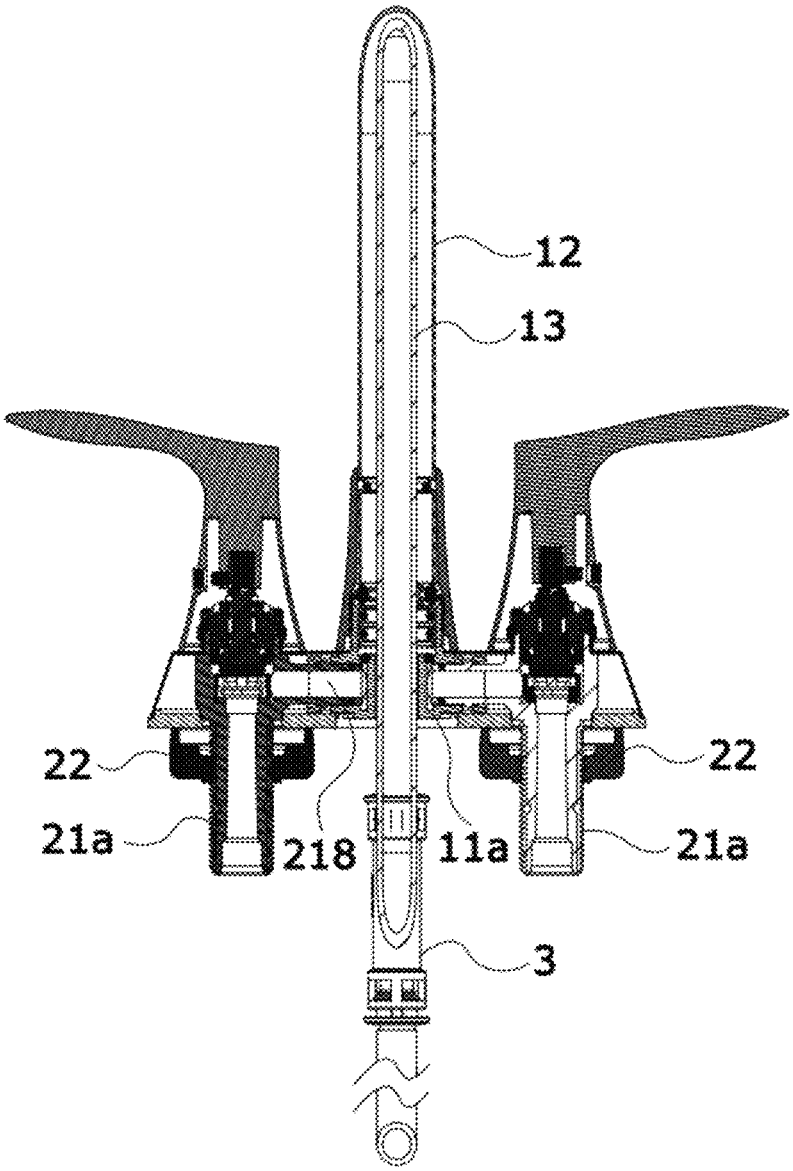
FIG. 3 is a front cross-sectional view of the multifunctional faucet in the first embodiment of the present disclosure.
Figure 4:
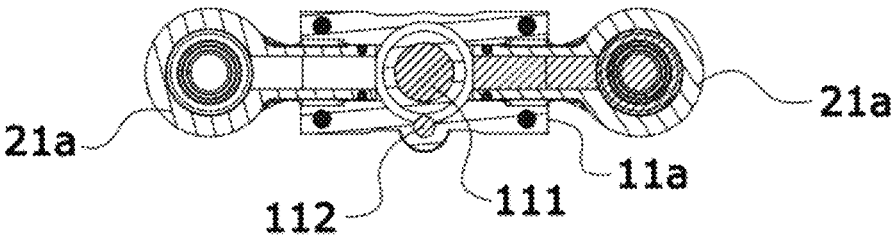
FIG. 4 is a top cross-sectional view of the multifunctional faucet in the first embodiment of the present disclosure.
Figure 5:
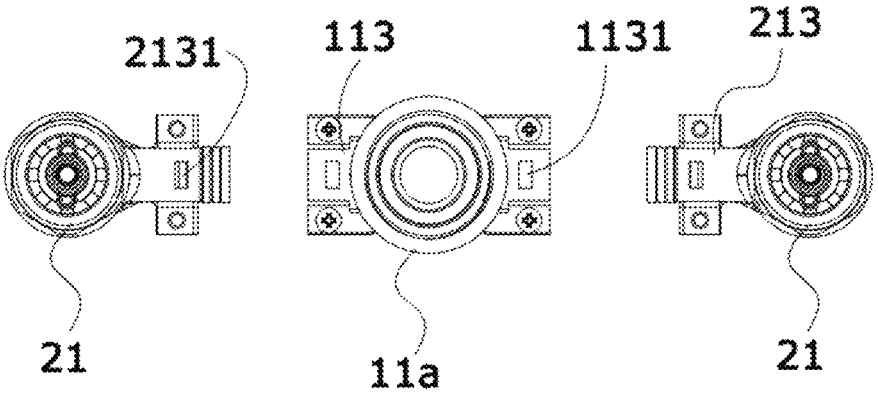
FIG. 5 is a schematic top view illustrating installation of a main body in the first embodiment of the present disclosure.
Figure 6:
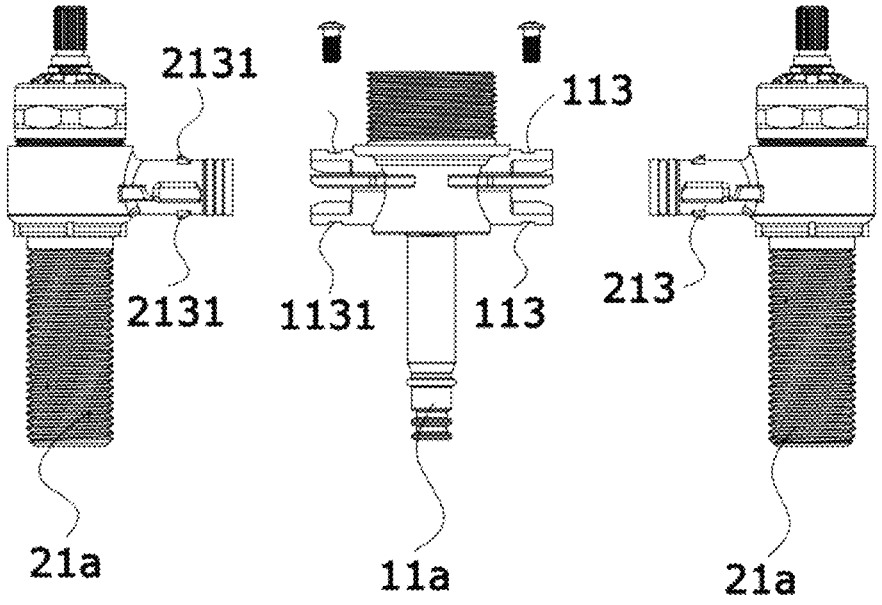
FIG. 6 is a schematic front view illustrating the installation of the main body in the first embodiment of the present disclosure.
Figure 7:
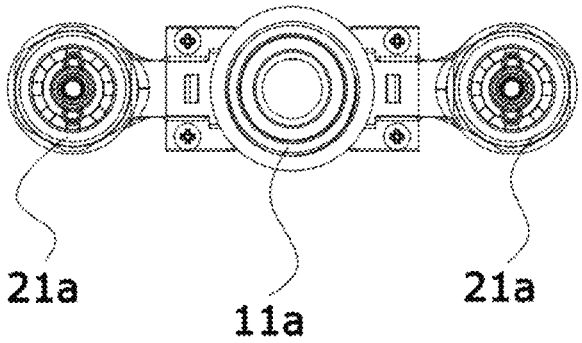
FIG. 7 is a top view of the main body in the first embodiment of the present disclosure.
Figure 8:
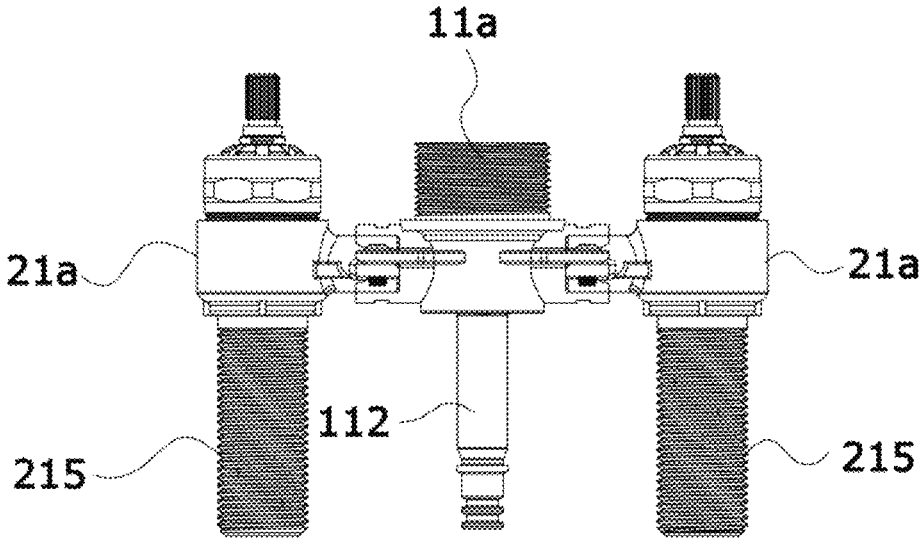
FIG. 8 is a front view of the main body in the first embodiment of the present disclosure.

Referring to FIGS. 3 and 4, the first main body 11*a* defines a first channel 111 and a second channel 112, the first channel 111 and the second channel 112 are disposed side by side, and the second channel 112 is communicated with the fourth channel 218. The first channel 111 is communicated with the support tube 12, and a water inlet end of the water outlet tube 13 sequentially passes through the support tube 12 and the first channel 111 from one side of the end face 121 of the support tube 12. A quick connecting assembly 3 is connected between the water inlet end of the water outlet tube 13 and the second channel 112.

Figure 9:
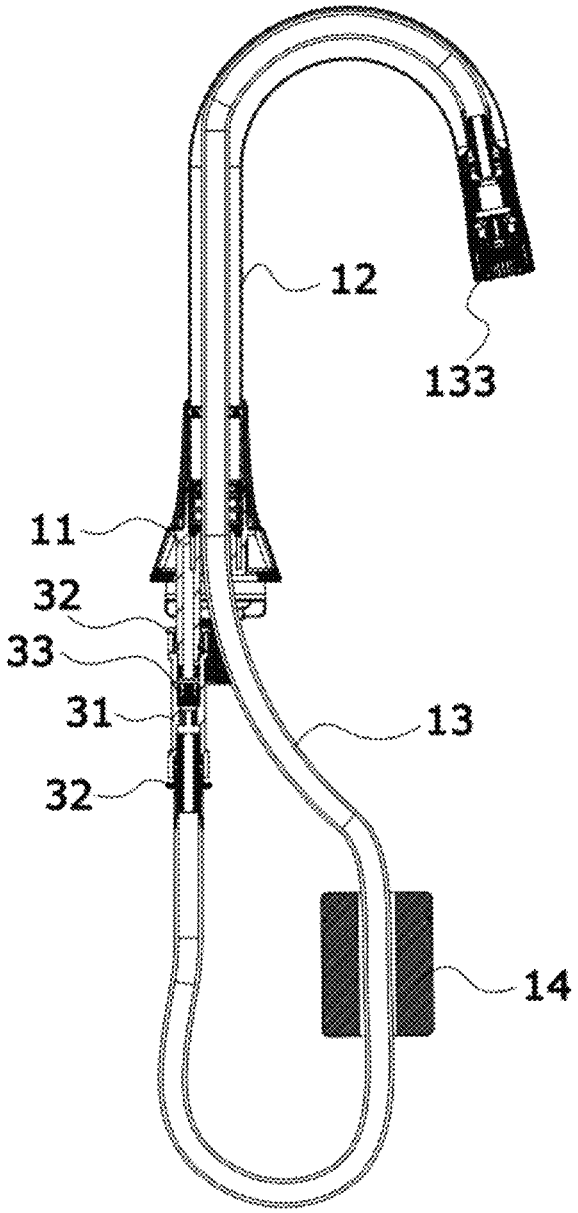
FIG. 9 is a left side cross-sectional view in the first embodiment of the present disclosure.
Figure 10:
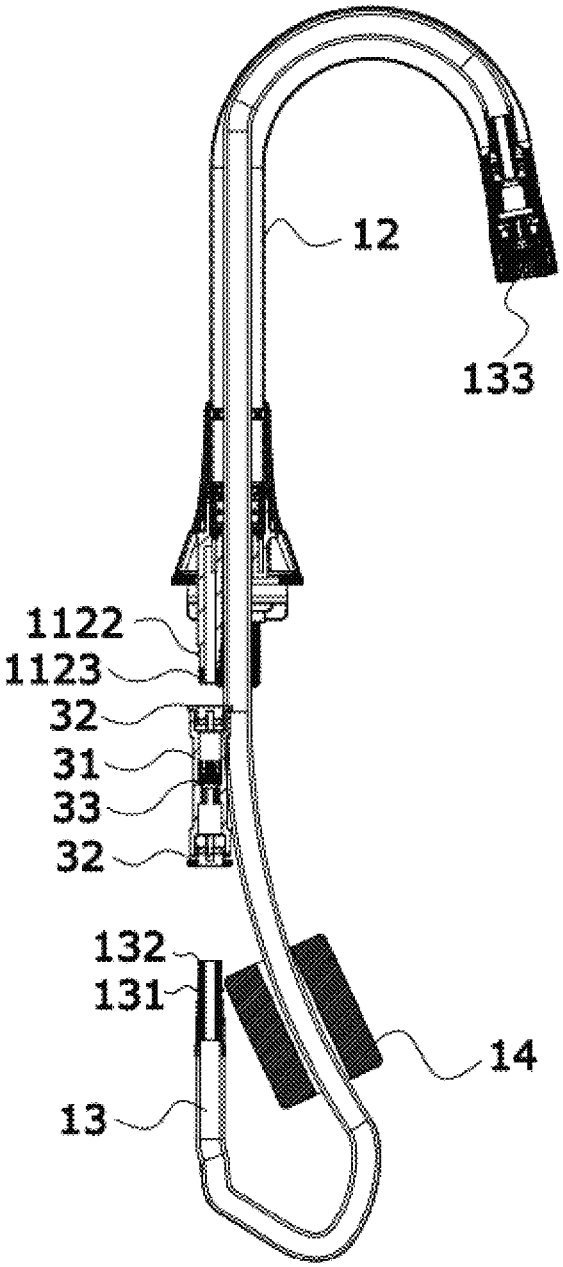
FIG. 10 is a schematic view illustrating installation of a quick connecting assembly in the first embodiment of the present disclosure.
Figure 11:
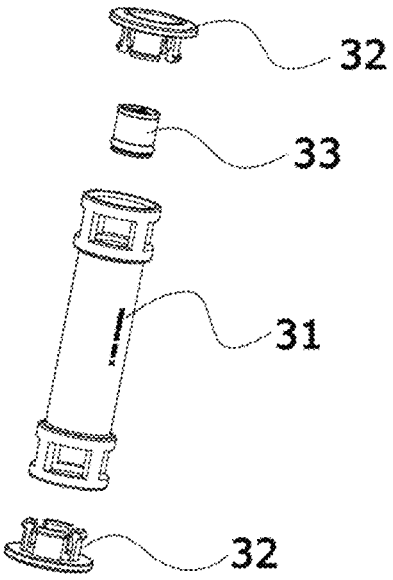
FIG. 11 is an exploded view of the quick connecting assembly in the first embodiment of the present disclosure.
Figure 12:
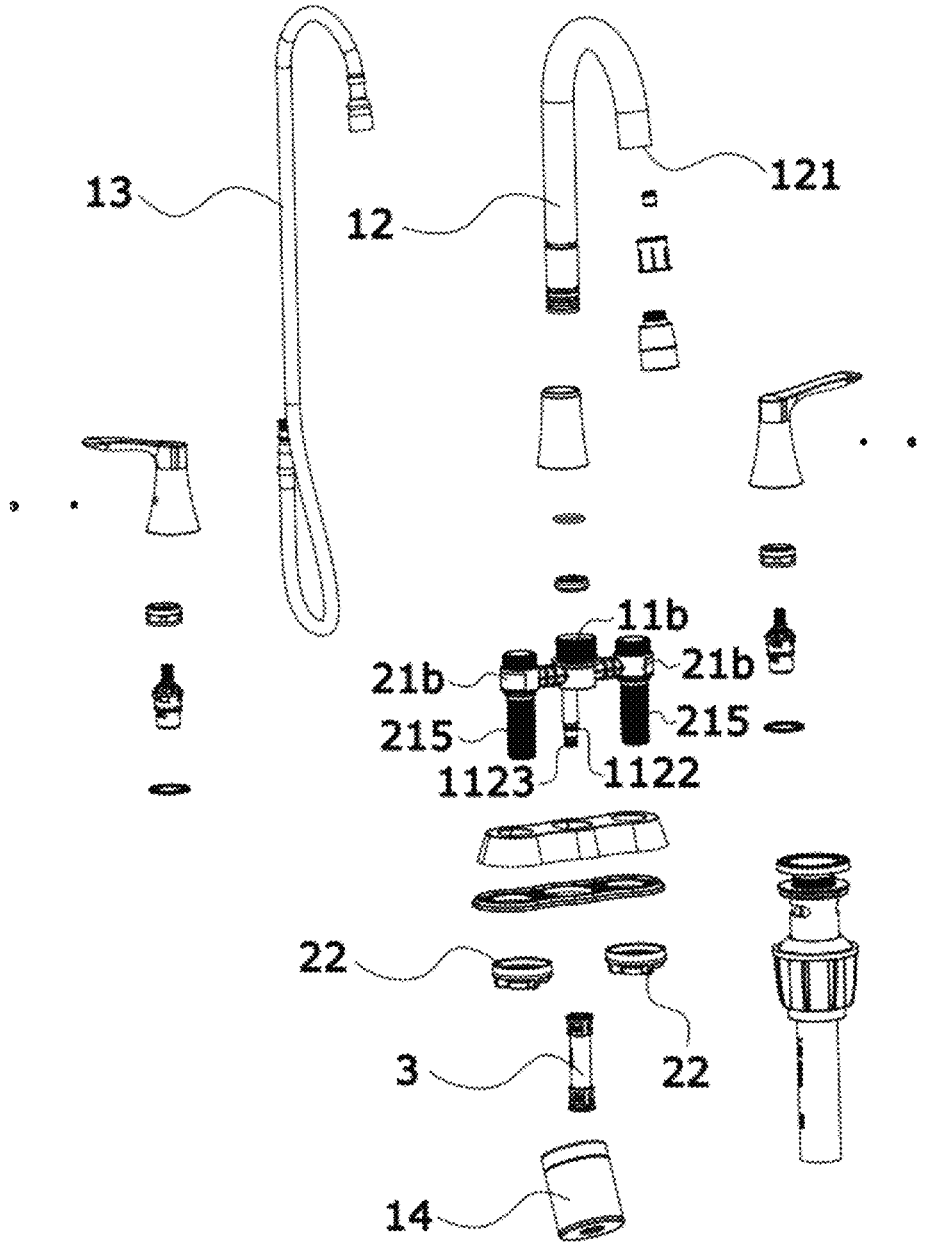
FIG. 12 is an exploded view of a multifunctional faucet in a second embodiment of the present disclosure.
Figure 13:
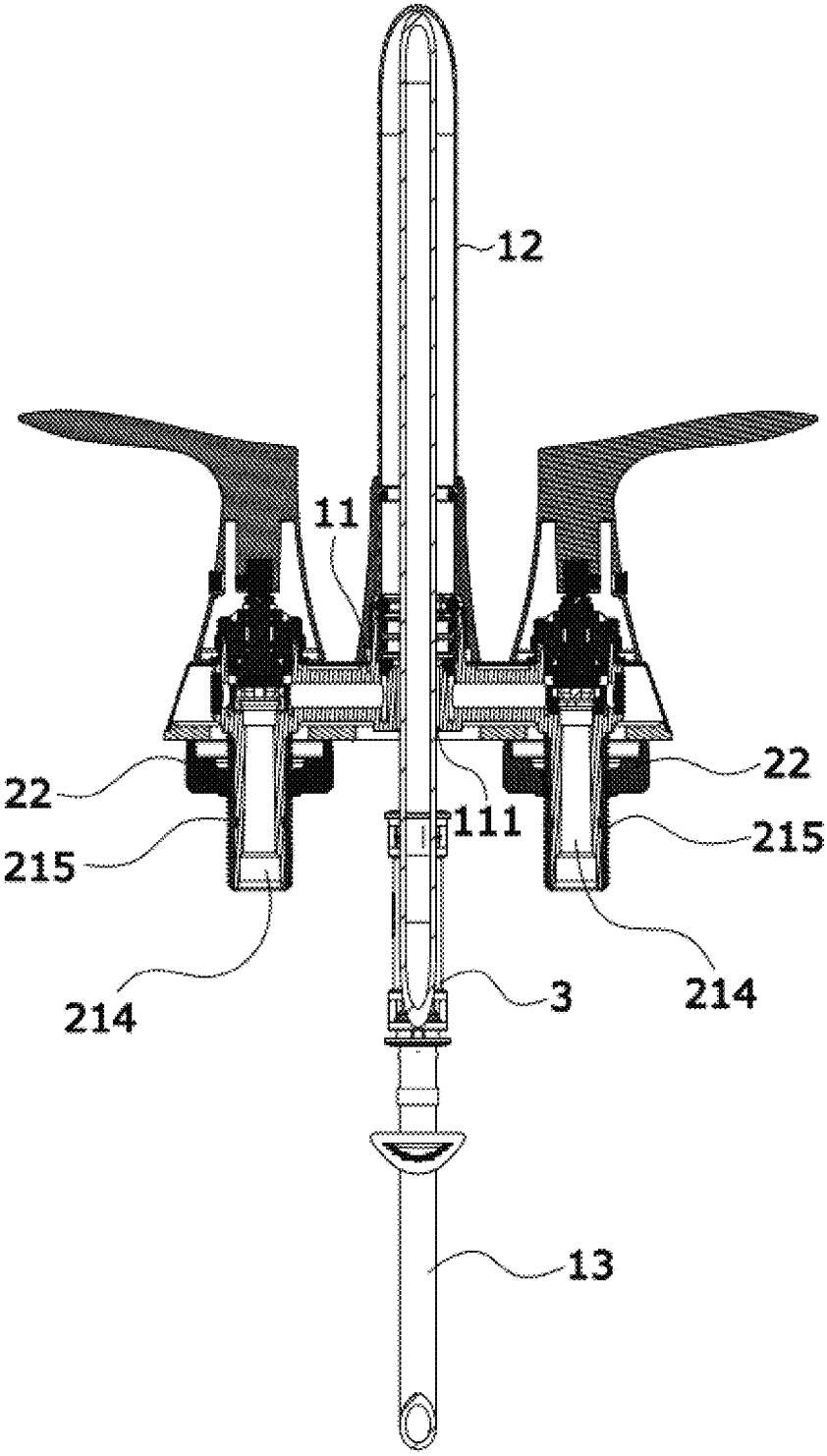
FIG. 13 is a front cross-sectional view of the multifunctional faucet in the second embodiment of the present disclosure.
Figure 14:
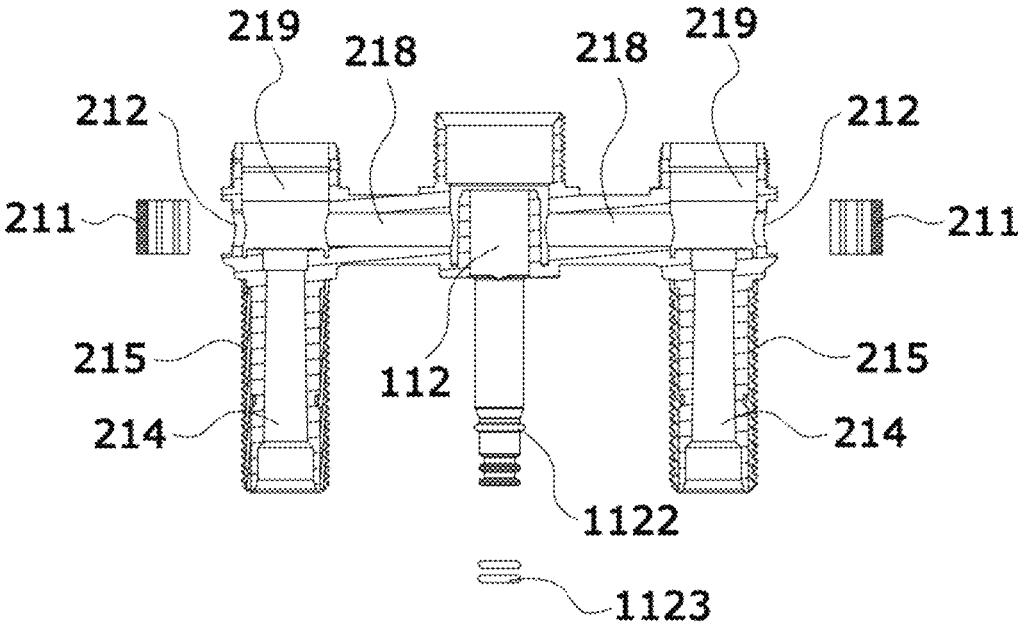
FIG. 14 is an exploded view of a front cross-sectional view of a main body in the second embodiment of the present disclosure.
Figure 15:
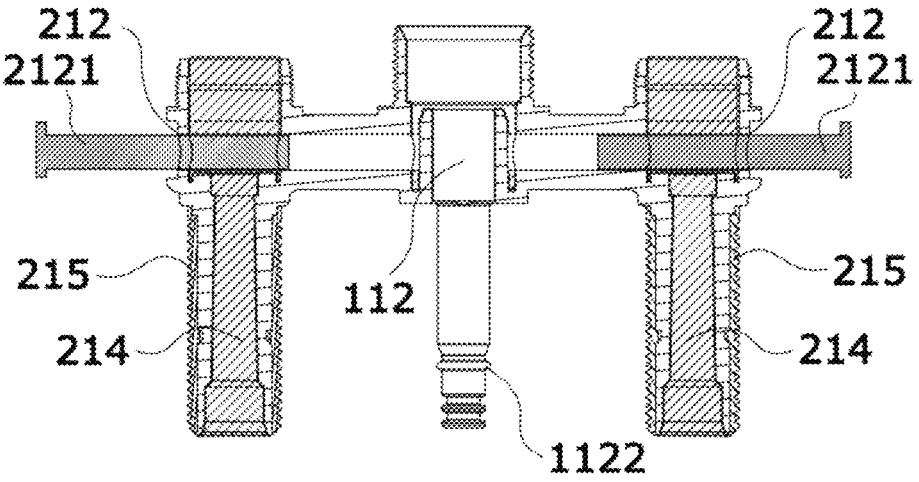
FIG. 15 is a first schematic view illustrating formation of the main body in the second embodiment of the present disclosure.
Figure 16:
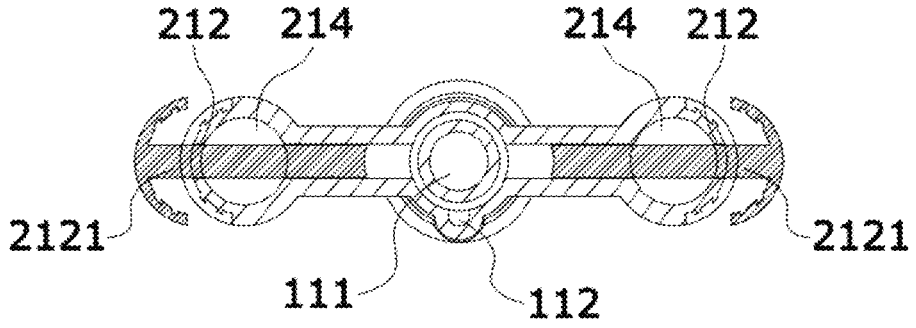
FIG. 16 is a second schematic view illustrating the formation of the main body in the second embodiment of the present disclosure.
Figure 17:
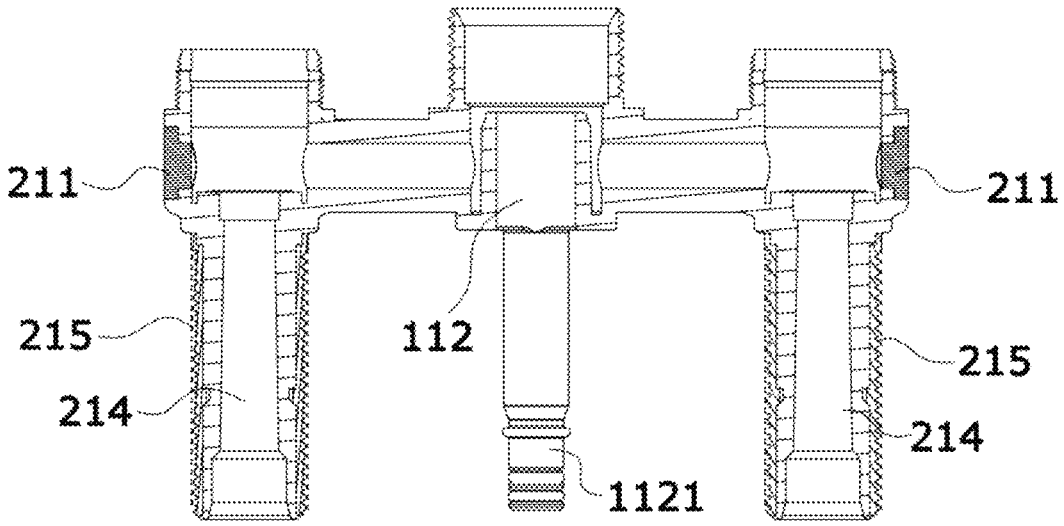
FIG. 17 is a third schematic view illustrating the formation of the main body in the second embodiment of the present disclosure.
Figure 18:
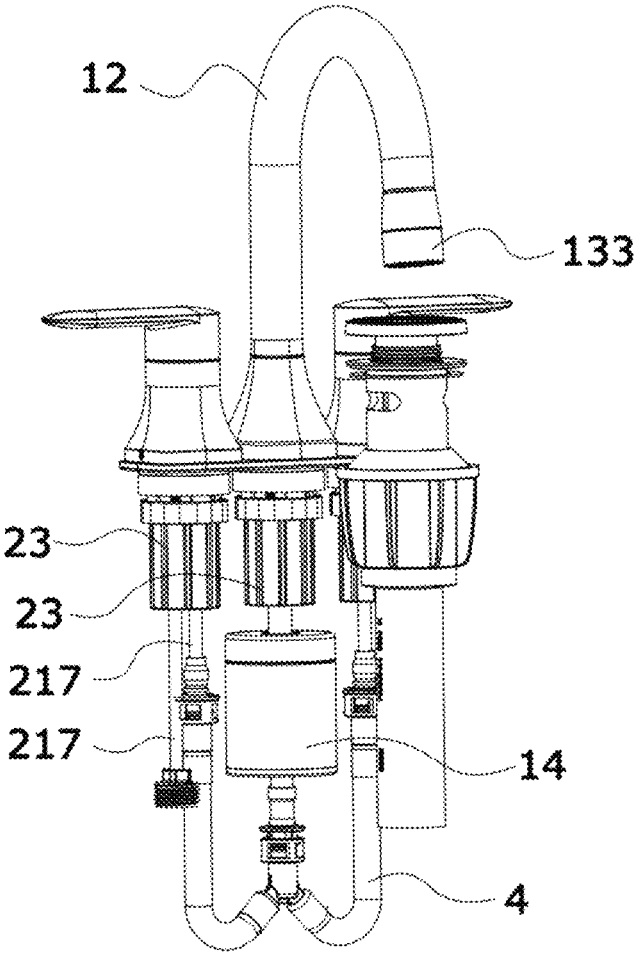
FIG. 18 is a first axonometric view of a multifunctional faucet in a third embodiment of the present disclosure.
Figure 19:
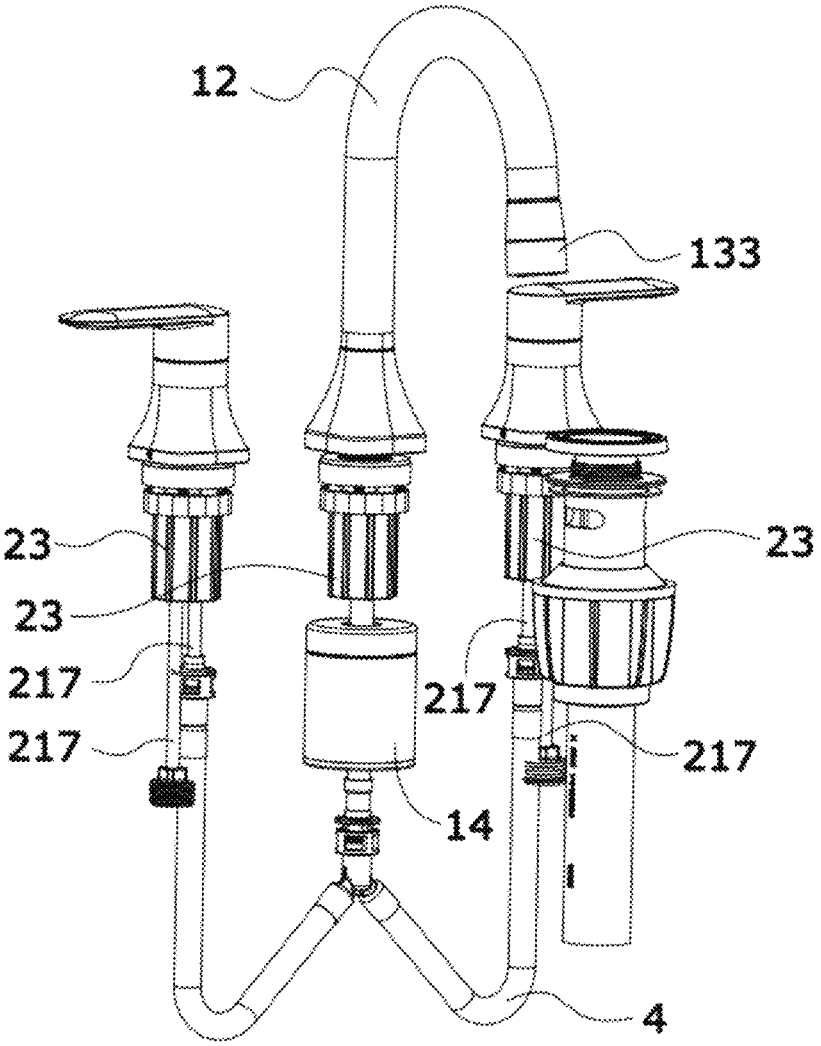
FIG. 19 is a second axonometric view of the multifunctional faucet in the third embodiment of the present disclosure.
Figure 20:
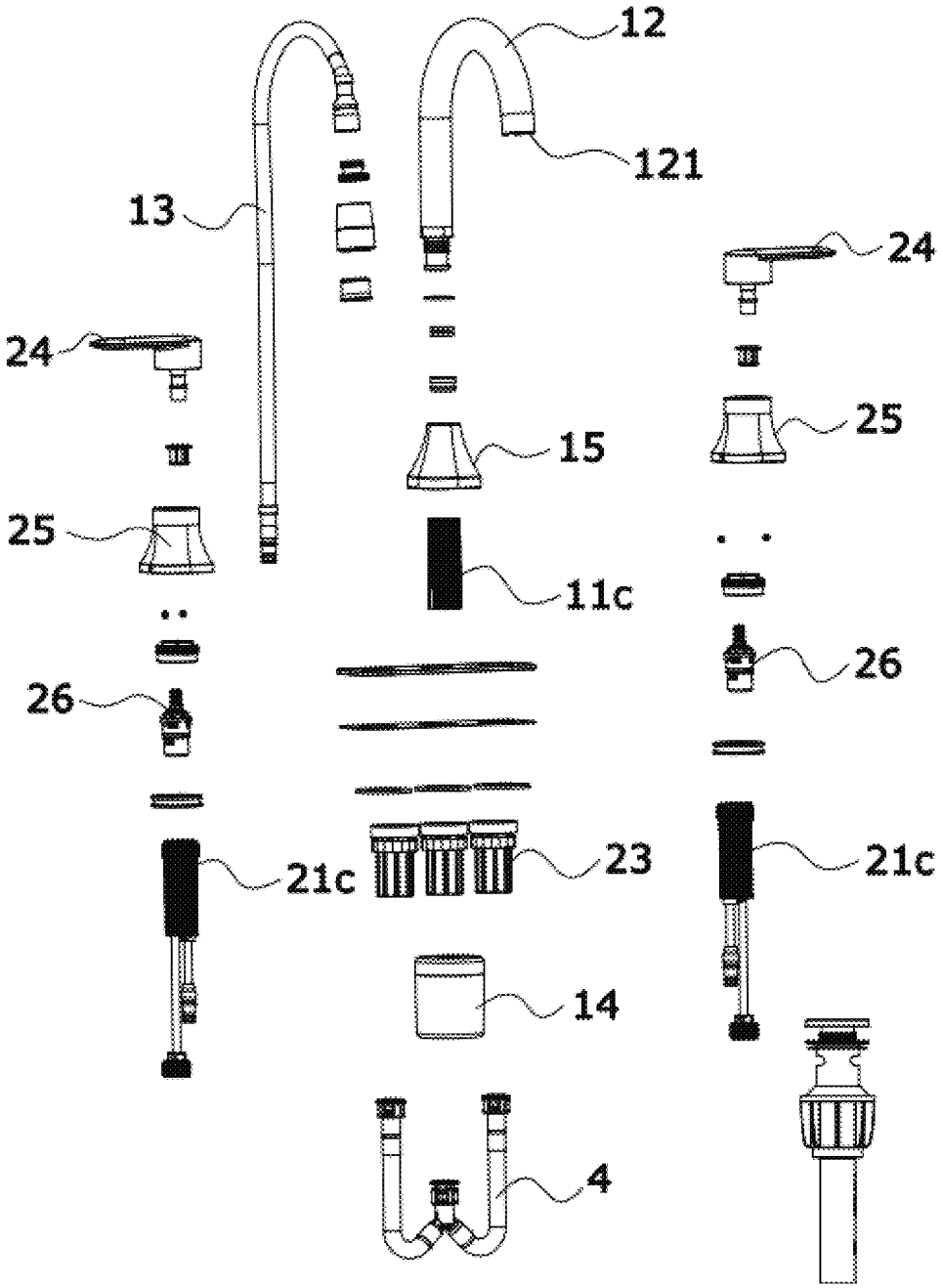
FIG. 20 is an exploded view of the multifunctional faucet in the third embodiment of the present disclosure.
Figure 21:
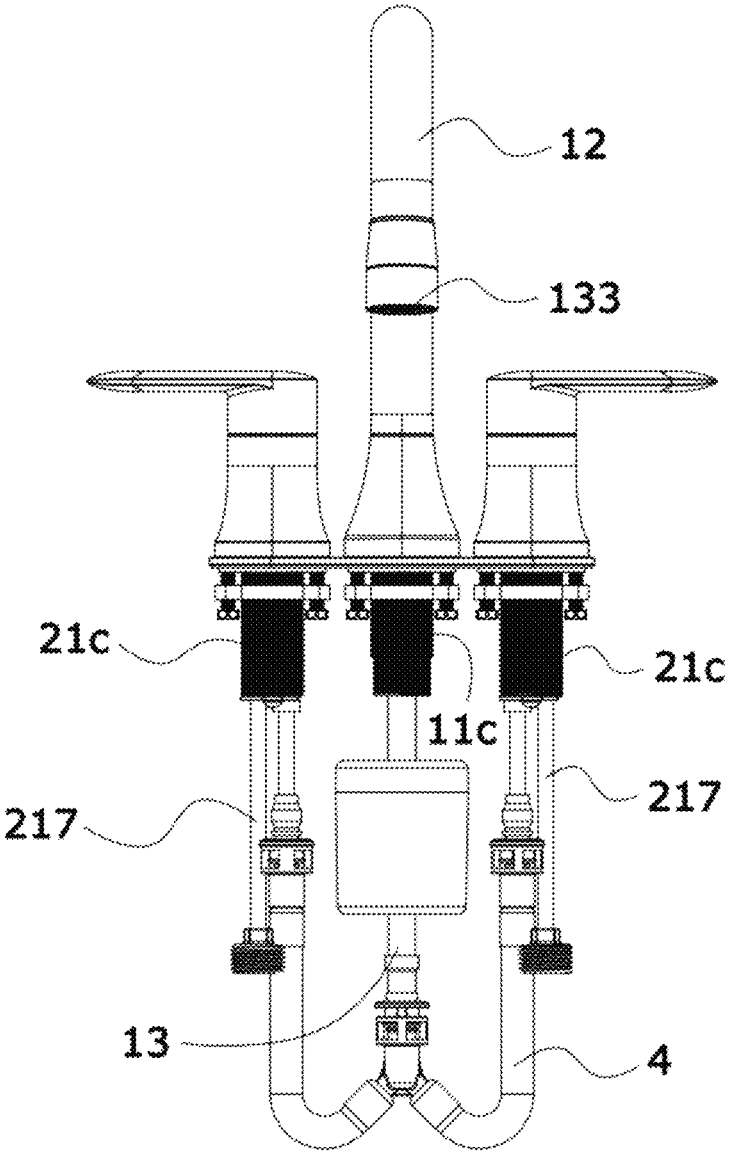
FIG. 21 is a front view of the multifunctional faucet in the third embodiment of the present disclosure.
Figure 22:
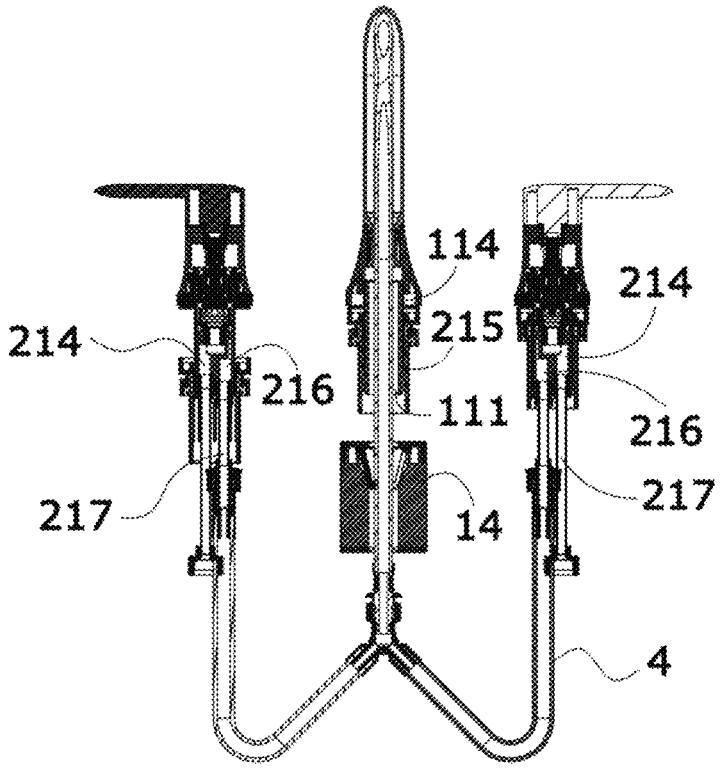
FIG. 22 is a front cross-sectional view of the multifunctional faucet in the third embodiment of the present disclosure.

Referring to FIGS. 9 to 11, the quick connecting assembly 3 includes an adapter 31 and two clamping ring elements 32, and each of two opposite ends of the adapter 31 is provided with one clamping ring element 32. A peripheral circle 1121 of the second channel 112 and the water inlet end of the water outlet tube 13 are both provided with a positioning rib 1122 and a sealing element 1123. The water inlet end of the water outlet tube 13 is away from the end face 121 of the support tube 12. The two positioning ribs 131 and 1122 are respectively inserted into the two clamping ring elements 32. The clamping buckle element 143 on the clamping ring element 32 rebounds and directly jams the positioning rib 131 and positioning rib 1122, so that the peripheral circle 1121 of the second channel 112 and the water inlet end of the water outlet tube 13 are not easily detached from the quick connecting assembly 3. When the peripheral circle 1121 of the second on-off and/or the water inlet end of the water outlet tube 13 need to be separated from the quick connecting assembly 3, the clamping ring element 32 may be separated by pushing up to the adapter 31 and pulling out. The adapter 31 may be provided with a check valve 33 or a water saving plate, which may be disposed according to the user's functional requirements.

A lower part of the second main body 21*a* defines the third channel 214, and an outer wall circumference of the third channel 214 is provided with a connection part 215. The connection part 215 fixes the second main body 21*a* to an external element through a locking nut 22. In the present embodiment, the connection part 215 is disposed as an external threaded structure, and the locking nut 22 is disposed as an internal threaded structure. The second main body 21*a* passes through an installation hole on the installation table, such as the installation hole on the bathroom cabinet table. The locking nut 22 is screwed and tightened with the connection part 215, thereby fixing the main control unit 2 and the water outlet unit 1 on the installation table.

Example 2

Referring to FIGS. 12 to 17, a first main body 11*b* and a second main body 21*b* are injection molded into a whole.

During injection molding, the first main body 11*b* and the second main body 21*b* have been manufactured as a whole. However, one end of the second main body 21*b* away from the first main body 11*b* is provided with a sealing water outlet 212. During manufacturing a mold, a mold core 2121 is drawn out from the sealing water outlet 212 to form the fourth channel 218. The sealing water outlet 212 is provided with a sealing water plate 211, and the sealing water plate 211 and the whole are secondary injection molded to seal the sealing water outlet 212.

In the present embodiment, a flange 15 and a flange 25 are disposed on the first main body 11*b*, and the support tube 12 is inserted onto the flange 15. The handle 24 has a decorative cover extending downward. A bottom surface of the flange 15 and a bottom surface of the flange 25 are flush with a bottom surface of the decorative cover, and a panel 16 is disposed below the bottom surface. The panel 16 covers the first main body 11*b* and the second main body 21*b*. The flange 15, the flange 25, the handle 24 and its decorative cover, and the panel 16 are used as exterior elements to cover the valve core, the first main body 11*b*, and the second main body 21*b*. The other structures of the present embodiment are conventional structures, and the other structures of the present embodiment are the same as those of the first embodiment, which are not repeated here.

Example 3

Referring to FIGS. 18 to 29, the first main body 11*c* and the second main body 21*c* are disposed separately, so that the main control unit 2 and the water outlet unit 1 are disposed separately. The first main body 11*c* and the two second main bodies 21*c* are spaced apart from each other, and the first main body 11*c* is located between the two second main bodies 21*c*. The first main body 11*c* is not communicated with the second main body 21*c*, and the water outlet tube 13 runs through the first main body 11. A hose assembly 4 is connected between the second main body 21*c* and the water outlet tube 13*c*.

The first main body 11*c* defines the first channel 111, and the second main body 21*c* defines a fifth channel 216 and the third channel 214. The fifth channel 216 and the third channel 214 are disposed in parallel and respectively connected to a connection tube 217. The water outlet tube 13 passes through the first channel 111 and is connected to the fifth channel 216 through the hose assembly 4.

Figure 25:
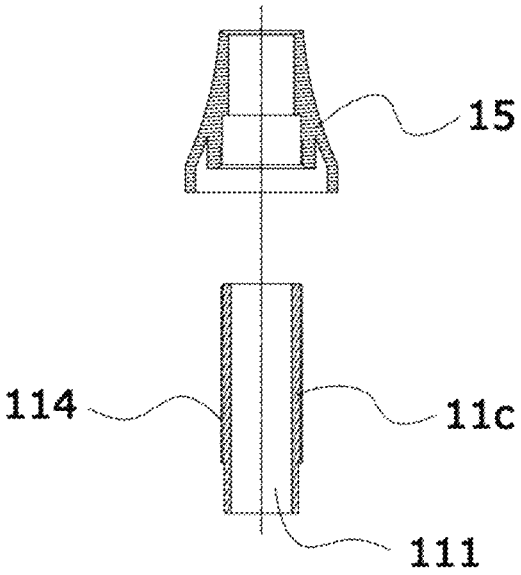
FIG. 25 is a first view illustrating an installation step of the first main body in the third embodiment of the present disclosure.
Figure 26:
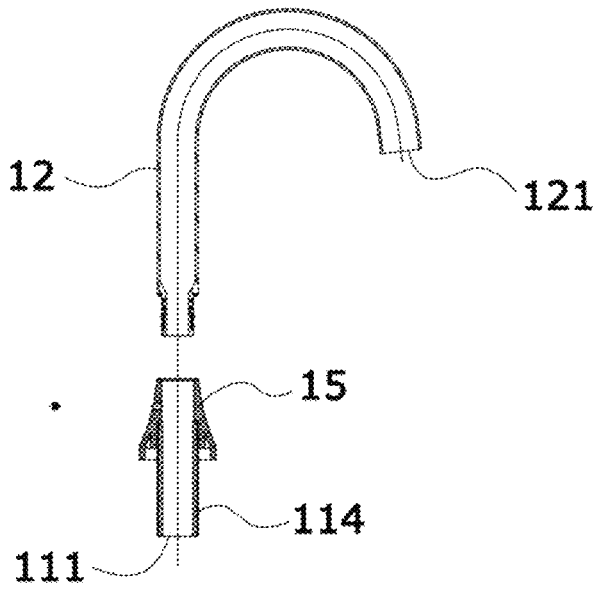
FIG. 26 is a second view illustrating an installation step of the first main body in the third embodiment of the present disclosure.
Figure 27:
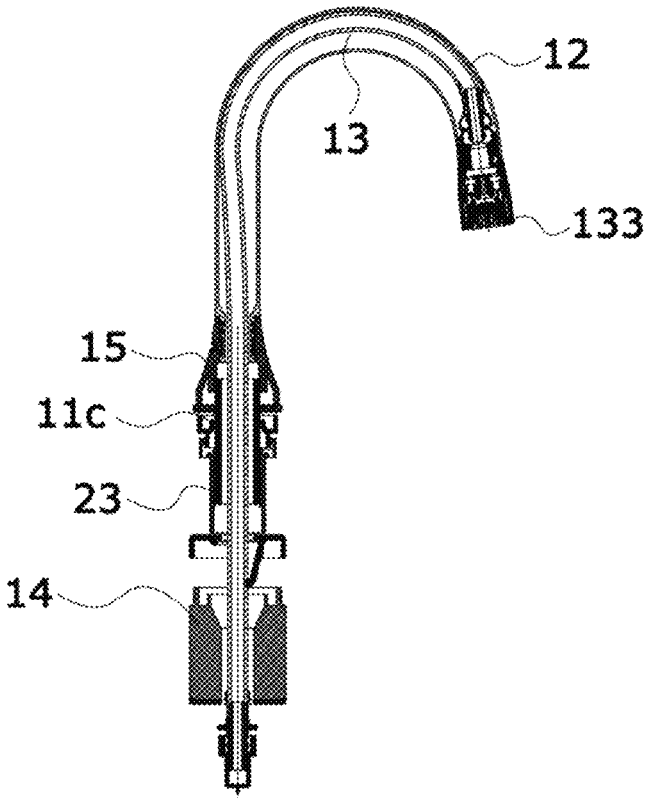
FIG. 27 is a view illustrating an installation step of a counterweight block in the third embodiment of the present disclosure.

An outer wall of each of the first main body 11*c* and the second main body 21*c* is provided with a connection part 114 and the connection part 215. The connection part 114 and the connection part 215 fix the first main body 11*c* and the second main body 21*c* to the external element through a quick connecting nut assembly 23. In the present embodiment, each of the connection part 114 and the connection part 215 are disposed as the external threaded structure, and the quick connecting nut assembly 23 is disposed as the internal threaded structure. The first main body 11*c* and the second main body 21*c* pass through the installation holes on the installation table, such as the installation holes on the bathroom cabinet table. The quick connecting nut assembly 23 is screwed and tightened with the connection part 114 and the connection part 215, thereby fixing the main control unit 2 and the water outlet unit 1 on the installation table. The first main body 11*c* and the second main body 21*c* are both covered with the flange 15 and the flange 25, as shown in FIG. 25, the first main body 11*c* and the second main body 21*c* are connected to the bottom of the flange 15 and the flange 25. As shown in FIG. 26, the support tube 12 is inserted into the upper end of the flange 15.

Figure 23:
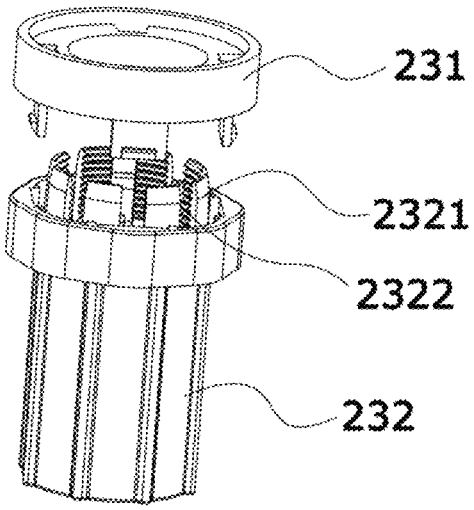
FIG. 23 is an exploded view of a quick connecting nut assembly in the third embodiment of the present disclosure.
Figure 24:
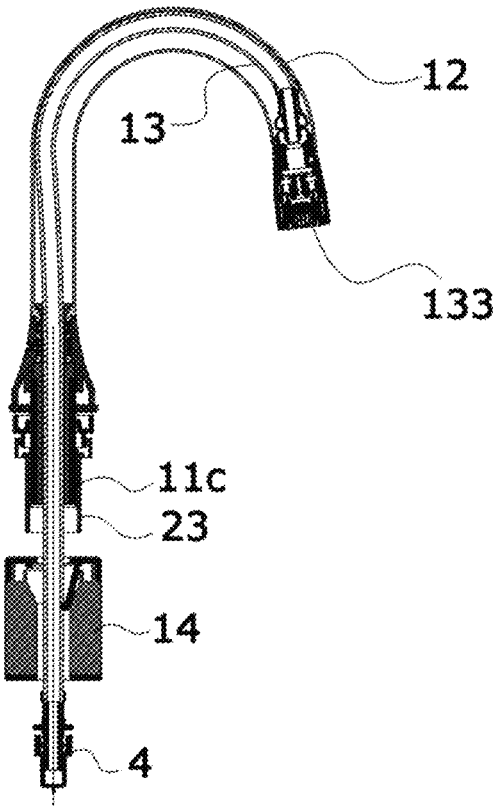
FIG. 24 is a schematic view illustrating installation of a first in body and a support tube in the third embodiment of the present disclosure.

Referring to FIG. 23, the quick connecting nut assembly 23 includes an upper body 231 and a lower body 232. Multiple ribs 2321 are disposed in a ring on one end of the lower body 232 close to the upper body 231, and movable teeth 2322 are disposed on an inner wall of the ribs 2321. In the present embodiment, the movable teeth 2322 are disposed as the internal thread structure. When installing the quick connecting nut, the quick connecting nut is inserted into the first main body 11*c* and/or the second main body 21*c* from bottom to top, and pushed upward until the upper body 231 presses against the flange 15 and the flange 25, then the lower body 232 is rotated. In this case, the movable lower body 232 drives the ribs 2321 to move inward, and the movable teeth 2322 hug the external threaded structure. When it needs to be removed, the lower body 232 is loosened and pulled out downward. Compared with the locking nut 22, the installation mode of the quick connecting nut assembly 23 is more rapid and convenient. The quick connecting nut assembly 23 may be used in the example 1 and example 2.

Figure 28:
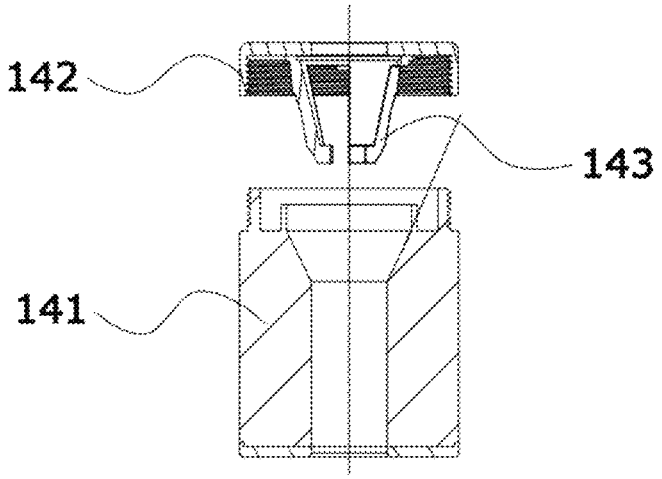
FIG. 28 is a schematic view illustrating the installation of the counterweight block in the third embodiment of the present disclosure.
Figure 29:
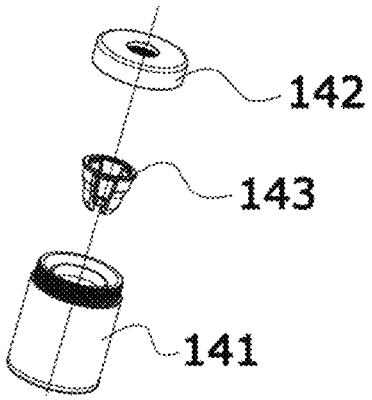
FIG. 29 is an exploded view of the counterweight block in the third embodiment of the present disclosure.

Referring to FIGS. 28 and 29, the counterweight block 14 includes a body 141 and an upper cover 142 disposed on the body 141. A clamping buckle is disposed on a side of the upper cover 142 close to the body 141. The upper cover 142 and the clamping buckle are first installed into the water outlet tube 13, and then installed into the body 141. After adjusting the upper cover 142, the clamping buckle, and the body 141 to a suitable position, screw teeth of the upper cover 142 and screw teeth of the body 141 are slowly tightened, and the clamping buckle gradually retracts due to the internal inclination of the body 141 until the water outlet tube 13 is tightly held. Of course, the conventional counterweight block 14 may be used in the example 1 and the example 2. The other structures are conventional structures or the same as those of the first embodiment and the second embodiment, which are not repeated here.

The above embodiments are only the preferred embodiments of the present disclosure and are not used to restrict the present disclosure. For those skilled in the art, the present disclosure may have various modifications and variations. Any modification, equivalent replacement, improvement, etc. made in the spirit and principle of the present disclosure should be included in the scope of protection of the present disclosure.

What is claimed is:

1. A multifunctional faucet with a pull-out function, comprising:

a water outlet unit comprising:

a first main body and two second main bodies;

a support tube disposed on the first main body;

a water outlet tube being moveable through the first main body and the support tube; and a counterweight block sleeved on the water outlet tube; wherein a water outlet end of the water outlet tube is fitted to an end face of the support tube, and the counterweight block is disposed away from one end of the support tube; when the water outlet end of the water outlet tube is pulled out, the water outlet end of the water outlet tube is away from the end face of the support tube; and when the water outlet tube is released, the counterweight block drives the water outlet tube to reset; and at least two main control units, wherein the water outlet unit and the two main control units are spaced apart from each other;

wherein the first main body and the two second main bodies form a unitary integral structure;

wherein each of the two second main bodies comprises a fourth channel extending therein and a sealing water outlet disposed at an end of the second main body distal to the first main body, the sealing water outlet forming an external opening of the fourth channel to provide access for a mold core; and wherein a sealing water plate is fixedly mounted at each sealing water outlet to seal the fourth channel.

2. The multifunctional faucet with the pull-out function according to claim 1, wherein the first main body defines a first channel and a second channel, and the first channel and the second channel are disposed side by side; the first channel is communicated with the support tube, and the water outlet tube sequentially passes through the support tube and the first channel; and a quick connecting assembly is connected between the second channel and the water outlet tube.

3. The multifunctional faucet with the pull-out function according to claim 2, wherein the quick connecting assembly comprises an adapter and two clamping ring elements, and each of two opposite ends of the adapter is provided with one clamping ring element; each of a peripheral circle of the second channel and one end of the water outlet tube away from the support tube is provided with a positioning rib and a sealing element, and two positioning ribs are respectively inserted into the two clamping ring elements.

4. The multifunctional faucet with the pull-out function according to claim 3, wherein a check valve or a water saving plate is disposed in the adapter.

5. The multifunctional faucet with the pull-out function according to claim 4, wherein the counterweight block comprises:

a body defining a tapered receiving portion;

an upper cover threadedly engaged with the body; and a clamping buckle element comprising a plurality of claws extending into the tapered receiving portion of the body;

wherein, as the upper cover is screwed downward relative to the body, the tapered receiving portion forces the plurality of claws to contract radially, thereby securely clamping the water outlet tube passing therethrough.

6. The multifunctional faucet with the pull-out function according to claim 3, wherein the counterweight block comprises:

a body defining a tapered receiving portion;

an upper cover threadedly engaged with the body; and a clamping buckle element comprising a plurality of claws extending into the tapered receiving portion of the body:

wherein, as the upper cover is screwed downward relative to the body, the tapered receiving portion forces the plurality of claws to contract radially, thereby securely clamping the water outlet tube passing therethrough.

7. The multifunctional faucet with the pull-out function according to claim 2, wherein the counterweight block comprises:

a body defining a tapered receiving portion;

an upper cover threadedly engaged with the body; and a clamping buckle element comprising a plurality of claws extending into the tapered receiving portion of the body;

wherein, as the upper cover is screwed downward relative to the body, the tapered receiving portion forces the plurality of claws to contract radially, thereby securely clamping the water outlet tube passing therethrough.

8. The multifunctional faucet with the pull-out function according to claim 1, wherein a lower part of each of the second main bodies defines a third channel, an outer wall circumference of the third channel is provided with a connection part, and the connection part is configured to fix the second main body to an external element through a locking nut.

9. The multifunctional faucet with the pull-out function according to claim 1, wherein the counterweight block comprises:

a body defining a tapered receiving portion;

an upper cover threadedly engaged with the body; and a clamping buckle element comprising a plurality of claws extending into the tapered receiving portion of the body;

wherein, as the upper cover is screwed downward relative to the body, the tapered receiving portion forces the plurality of claws to contract radially, thereby securely clamping the water outlet tube passing therethrough.

* * * * *